US011375766B2

(12) United States Patent
Durocher et al.

(10) Patent No.: US 11,375,766 B2
(45) **Date of Patent: *Jul. 5, 2022**

(54) ADJUSTABLE HELMET FOR A HOCKEY OR LACROSSE PLAYER

(71) Applicant: BAUER HOCKEY, LLC, Exeter, NH (US)

(72) Inventors: Jacques Durocher, Saint-Jerome (CA); Marie-Claude Genereux, Sainte-Therese (CA)

(73) Assignee: BAUER HOCKEY, LLC, Exeter, NH (US)

( * ) Notice: Subject to any disclaimer, the term of this patent is extended or adjusted under 35 U.S.C. 154(b) by 521 days.

This patent is subject to a terminal disclaimer.

(21) Appl. No.: 16/399,479

(22) Filed: Apr. 30, 2019

(65) Prior Publication Data

US 2019/0357626 A1 Nov. 28, 2019

Related U.S. Application Data

(63) Continuation of application No. 15/139,536, filed on Apr. 27, 2016, now Pat. No. 10,292,449, which is a (Continued)

(51) Int. Cl.

| | |
|---|---|
| ***A42B 3/32*** | (2006.01) |
| ***A42B 3/16*** | (2006.01) |
| ***A63B 71/10*** | (2006.01) |

(52) U.S. Cl.

CPC ..... *A42B 3/324* (2013.01); *A42B 3/16* (2013.01); *A42B 3/32* (2013.01); *A63B 71/10* (2013.01)

(58) Field of Classification Search

CPC .. A42B 3/324; A42B 3/32; A42B 3/16; A42B 1/22; A63B 71/10

(Continued)

(56) References Cited

U.S. PATENT DOCUMENTS 2,926,406 A 3/1959 Edwards et al.
3,107,356 A 10/1963 Pestronk et al.

(Continued)

FOREIGN PATENT DOCUMENTS

CA 1154552 A 10/1983
CA 1183302 A 3/1985

(Continued)

OTHER PUBLICATIONS

Bauer 8000, 5000 Helmet (see, for example, 2005 Bauer Catalogue).

(Continued)

*Primary Examiner* — Nathan E Durham
*Assistant Examiner* — Abby M Spatz
(74) *Attorney, Agent, or Firm* — Perkins Coie LLP

(57) ABSTRACT

An adjustable helmet having first and second shells and a single actuator comprising at least one tooth, the single actuator being moveable between: a first locked position, wherein the at least one tooth retains the first and second shells and the first and second shells define a first hollow space; a released position, wherein the at least one tooth no longer retains the first and second shells such that one of the first and second shells is moveable relative to the other of the first and second shells; and a second locked position, wherein the at least one tooth retains the first and second shells and the first and second shells define a second hollow space, the second hollow space being different than the first hollow space.

29 Claims, 15 Drawing Sheets

Related U.S. Application Data continuation of application No. 13/548,622, filed on Jul. 13, 2012, now Pat. No. 9,345,282.

(60) Provisional application No. 61/587,040, filed on Jan. 16, 2012, provisional application No. 61/512,076, filed on Jul. 27, 2011.

(58) Field of Classification Search
USPC ..... 2/417, 410, 418, 425, 419, 420
See application file for complete search history.

(56) References Cited

U.S. PATENT DOCUMENTS 3,214,809 A 11/1965 Edwards
3,845,505 A 11/1974 Davison et al.
3,897,597 A 8/1975 Kasper
4,404,690 A 9/1983 Farquharson
4,477,929 A 10/1984 Mattsson
4,539,715 A * 9/1985 Clement ..... A44B 11/12 2/420
4,685,315 A 8/1987 Comolli
4,827,537 A 5/1989 Villa
4,843,642 A 7/1989 Brower
4,903,349 A 2/1990 Arai
4,942,628 A 7/1990 Freund
5,249,347 A 10/1993 Martinitz
5,315,718 A 5/1994 Barson et al.
5,331,684 A 7/1994 Baril et al.
5,333,328 A 8/1994 Roberts
5,367,402 A 11/1994 Holmes et al.
5,412,814 A 5/1995 Pernicka et al.
5,483,699 A 1/1996 Pernicka et al.
RE35,193 E 4/1996 Shifrin
5,511,250 A 4/1996 Field et al.
5,555,567 A 9/1996 Corpus
5,555,569 A 9/1996 Lane
5,571,217 A 11/1996 Del Bon et al.
5,603,117 A 2/1997 Hudner, Jr. et al.
5,638,551 A 6/1997 Lallemand
5,659,900 A 8/1997 Arney et al.
5,680,656 A 10/1997 Gath
5,752,276 A 5/1998 Baudou et al.
D400,311 S 10/1998 Chartrand
D401,018 S 11/1998 Chartrand
5,832,569 A 11/1998 Berg
5,845,341 A 12/1998 Barthold et al.
5,857,215 A 1/1999 Fergason et al.
5,887,288 A 3/1999 Arney et al.
5,950,245 A 9/1999 Binduga
5,953,761 A 9/1999 Jurga et al.
5,956,776 A 9/1999 Chartrand
6,032,297 A 3/2000 Barthold et al.
6,047,409 A 4/2000 Simpson
6,101,636 A 8/2000 Williams
6,108,824 A 8/2000 Fournier et al.
6,125,477 A 10/2000 Crippa et al.
6,154,889 A 12/2000 Moore, III et al.
6,189,156 B1 2/2001 Loiars
6,202,223 B1 3/2001 Chartrand
6,256,798 B1 7/2001 Eolf et al.
6,260,197 B1 7/2001 Hoogewind
6,272,692 B1 8/2001 Abraham
6,292,952 B1 9/2001 Watters et al.
6,298,497 B1 10/2001 Chartrand
6,314,588 B1 11/2001 Fang
6,324,700 B1 12/2001 McDougall
6,338,165 B1 1/2002 Biondich
6,385,780 B1 5/2002 Racine
6,389,607 B1 5/2002 Wood
6,401,261 B1 6/2002 Arney et al.
6,425,142 B2 7/2002 Sasaki et al.
6,457,179 B1 10/2002 Prendergast
6,472,776 B1 10/2002 Soto et al.
6,499,149 B2 12/2002 Ashline
6,606,114 B1 8/2003 Gordon et al.
6,647,556 B2 11/2003 Grepper et al.
6,708,376 B1 3/2004 Landry
6,715,150 B1 4/2004 Potin
6,754,911 B1 6/2004 Howell
6,772,447 B2 8/2004 Morrow et al.
6,862,747 B2 3/2005 Oleson
6,862,748 B2 3/2005 Prendergast
6,865,752 B2 3/2005 Udelhofen et al.
6,883,183 B2 4/2005 Morrow et al.
6,886,183 B2 5/2005 DeHaan et al.
6,892,393 B1 5/2005 Provost et al.
6,904,618 B2 6/2005 Musal
6,934,972 B2 8/2005 Desjardins et al.
6,952,839 B2 10/2005 Long
6,961,963 B2 11/2005 Rosie
6,966,075 B2 11/2005 Racine
6,968,575 B2 11/2005 Durocher
6,981,284 B2 1/2006 Durocher
6,983,488 B2 1/2006 Foote et al.
7,000,262 B2 2/2006 Bielefeld
7,043,772 B2 5/2006 Bielefeld
7,110,743 B2 9/2006 Depew et al.
7,156,536 B1 1/2007 McCorkle
7,174,575 B1 2/2007 Scherer
7,178,175 B2 2/2007 Rogers et al.
7,192,151 B2 3/2007 Clupper et al.
7,222,374 B2 3/2007 Musal et al.
7,246,383 B2 7/2007 Musal
7,246,385 B2 7/2007 Dennis et al.
7,634,820 B2 12/2009 Rogers et al.
7,716,754 B1 5/2010 Ross
D618,857 S 6/2010 Durocher
7,797,763 B2 9/2010 Grau
7,797,764 B2 9/2010 Norris
7,854,024 B2 12/2010 Fang
7,870,618 B2 1/2011 Pilon et al.
7,908,667 B2 3/2011 Rogers et al.
7,908,678 B2 3/2011 Brine, III et al.
7,954,178 B2 6/2011 Durocher et al.
7,958,572 B2 6/2011 Loury et al.
7,975,320 B2 7/2011 Muskovitz et al.
8,037,548 B2 10/2011 Alexander et al.
8,095,995 B2 1/2012 Alexander et al.
8,146,177 B2 4/2012 Mangone
8,418,270 B2 4/2013 Desjardins et al.
8,661,571 B1 3/2014 Teetzel et al.
8,739,318 B2 6/2014 Durocher
8,813,269 B2 8/2014 Bologna et al.
8,832,870 B2 9/2014 Belanger et al.
9,345,282 B2 5/2016 Durocher et al.
10,292,449 B2 5/2019 Durocher et al.
2001/0034895 A1 11/2001 Ikeda
2002/0035748 A1 3/2002 Racine
2002/0104153 A1 8/2002 Benedict et al.
2003/0070201 A1 4/2003 McClelland
2003/0106138 A1 6/2003 Guay
2003/0135914 A1 7/2003 Racine et al.
2003/0221245 A1 12/2003 Chang et al.
2004/0040073 A1 3/2004 Morrow et al.
2004/0117897 A1 6/2004 Udelhofen et al.
2004/0172739 A1 9/2004 Racine
2005/0015857 A1 1/2005 Desjardins et al.
2005/0034222 A1 2/2005 Durocher
2005/0034223 A1 2/2005 Durocher
2005/0125882 A1 6/2005 Long
2005/0125961 A1 6/2005 Pontaoe
2005/0246868 A1 11/2005 Garofalo et al.
2005/0262619 A1 12/2005 Musal et al.
2006/0150304 A1 7/2006 Bentz
2007/0044193 A1 3/2007 Durocher et al.
2007/0079429 A1 4/2007 Pilon et al.
2007/0157370 A1 7/2007 Joubert Des Ouches
2007/0169251 A1 7/2007 Rogers et al.
2007/0199136 A1 8/2007 Brine, III et al.
2007/0266482 A1 11/2007 Alexander et al.
2008/0092279 A1 4/2008 Chiang
2008/0109946 A1 5/2008 Jourde et al.

(56) References Cited

U.S. PATENT DOCUMENTS

| | | | | |
|---|---|---|---|---|
| 2008/0189835 | A1* | 8/2008 | Mangone | A42B 3/324 2/420 |
| 2008/0289085 | A1 | 11/2008 | Bryant et al. | |
| 2009/0031482 | A1 | 2/2009 | Stokes et al. | |
| 2009/0044315 | A1 | 2/2009 | Belanger et al. | |
| 2009/0188022 | A1 | 7/2009 | Durocher et al. | |
| 2010/0050323 | A1 | 3/2010 | Durocher et al. | |
| 2012/0054947 | A1 | 3/2012 | Durocher | |
| 2013/0025032 | A1 | 1/2013 | Durocher et al. | |
| 2013/0025033 | A1 | 1/2013 | Durocher et al. | |
| 2013/0025034 | A1 | 1/2013 | Durocher | |
| 2016/0235151 | A1 | 8/2016 | Durocher et al. | |

FOREIGN PATENT DOCUMENTS

| | | | |
|---|---|---|---|
| CA | 1217601 | A | 2/1987 |
| CA | 2048028 | A1 | 2/1992 |
| CA | 2230616 | A1 | 3/1997 |
| CA | 2191683 | A1 | 5/1998 |
| CA | 2191693 | A1 | 5/1998 |
| CA | 2273621 | A1 | 2/2000 |
| CA | 2321399 | A1 | 3/2002 |
| CA | 2357690 | A1 | 3/2003 |
| CA | 2437545 | A1 | 2/2005 |
| CA | 2437626 | A1 | 2/2005 |
| CA | 2573639 | | 1/2006 |
| CA | 2573639 | A1 | 1/2006 |
| CA | 2573640 | | 1/2006 |
| CA | 2573640 | A1 | 1/2006 |
| CA | 2576086 | | 2/2006 |
| CA | 2576086 | A1 | 2/2006 |
| CA | 2561540 | A1 | 3/2007 |
| CA | 2567010 | A1 | 5/2007 |
| CA | 2567010 | | 1/2008 |
| CA | 2230616 | | 4/2008 |
| CA | 2357690 | | 1/2009 |
| CA | 2638703 | A1 | 2/2009 |
| CA | 2916360 | A1 | 2/2009 |
| CA | 2963353 | A1 | 2/2009 |
| CA | 2573639 | | 5/2012 |
| CA | 2917968 | | 1/2013 |
| CA | 2783079 | | 3/2016 |
| CA | 2917968 | | 4/2021 |
| CN | 101516221 | A | 8/2009 |
| DE | 4226551 | A1 | 2/1994 |
| DE | 10037461 | A1 | 2/2002 |
| EP | 1204336 | B1 | 9/2004 |
| EP | 1210882 | B1 | 4/2006 |
| EP | 1484990 | B1 | 10/2007 |
| EP | 1635664 | B1 | 8/2010 |
| EP | 2550885 | | 1/2013 |
| EP | 2550885 | B1 | 10/2013 |
| JP | 3122726 | U | 6/2006 |
| WO | 2004000054 | A2 | 12/2003 |
| WO | 2005000056 | A2 | 1/2005 |
| WO | 2006099928 | A1 | 9/2006 |
| WO | 2007025500 | A1 | 3/2007 |

OTHER PUBLICATIONS

CCM 1092/892 Helmets (see, for example, CCM 2006 Player Catalogue).

Cooper XLT Super Pro Helmet (see, for example, Cooper 1987 Catalogue).

Halstead, P.D., et al. "Hockey Headgear and the Adequacy of Current Designs and Standards", Safety in Ice Hockey, ASTM STP 1341, A.B. Ashare, Editor, American Society for Testing and Materials, 1998. 8 pages.

Mission Intake Helmet (see, for example, 2007 Hockey Catalogue).

Nike Bauer 8500/5500 Helmet (see, for example, 2006 Nike Bauer Catalogue).

Nike Quest Helmet (see, for example, 2004 Nike Player Catalogue).

RBK 8K and 6K Helmets (see, for example, 2006 RBK Hockey Catalog).

RBK 8K Helmet (see, for example, 2007 Roller Hockey Collection Catalogue).

Sport Maska Inc. d.b.a. Reebock-CCM Hockey,*Bauer Hockey Ltd.* v. *Sport Maska Inc. d.b.a. Reebok-CCM Hockey*, Federal Court of Canada, Court File No. T-123-15, Thrice Amended Statement of Defence and Counterclaim, Feb. 19, 2018, 43 pages.

Sport Maska Inc. d.b.a. CCM Hockey, *Bauer Hockey Ltd.* v. *Sport Maska Inc. d.b.da. CCM Hockey*, Federal Court of Canada, Court File No. T-123-15, Fourth Amended Statement of Defence and Counterclaim, May 25, 2018, 53 pages.

Sport Maska Inc. d.b.a. CCM Hockey, *Bauer Hockey Ltd.* v. *Sport Maska Inc. d.b.a. CCM Hockey*, Federal Court of Canada, Court File No. T-123-15, Fifth Amended Statement of Defence and Counterclaim, May 9, 2019, 80 pages.

Canadian Patent Office, Examiner's Report for Canadian Patent Application No. 2783079. dated Aug. 5, 2015. 5 pages.

Protest filed against Canadian Patent Application No. 2783079. Filed May 13, 2015. 156 pages.

Canadian Patent Office, Office Correspondence regarding protest against Canadian Patent Application No. 2783079. dated May 20, 2015. 2 pages.

Response to Examiner's Report of Aug. 5, 2015 in Canadian Patent Application No. 2,783,079. dated Dec. 9, 2015. 6 pages.

Extended European Search Report in European Patent Application No. 12177924.3 of Bauer Hockey Corp. dated Nov. 5, 2012. 4 pages.

USPTO, Non-Final Office Action for U.S. Appl. No. 13/548,622. dated Jul. 2, 2015. 17 pages.

USPTO, Non-Final Office Action for U.S. Appl. No. 13/548,622. dated Dec. 11, 2014. 14 pages.

Examiner-Initiated Interview Summary dated Dec. 19, 2018 in connection with U.S. Appl. No. 15/139,536, 1 page.

Examiner-Initiated Interview Summary dated Jan. 12, 2016 in connection with U.S. Appl. No. 13/548,622, 1 page.

Examiner's Report dated Dec. 18, 2014 in connection with Canadian Patent Application No. 2,783,079, 4 pages.

Examiner's Report dated Jun. 21, 2018 in connection with Canadian Patent Application No. 2,917,968, 6 pages.

Examiner's Report dated Mar. 17, 2020 in connection with CA Patent Application No. 2,917,968, 3 pages.

Final Office Action dated Jun. 29, 2017 in connection with U.S. Appl. No. 15/139,536, 8 pages.

Non-Final Office Action dated Oct. 11, 2016 in connection with U.S. Appl. No. 15/139,536, 6 pages.

Non-Final Office Action dated Jan. 26, 2018 issued in connection with U.S. Appl. No. 15/139,536, 14 pages.

Notice of Allowance dated Jan. 25, 2016 in connection with U.S. Appl. No. 13/548,622, 10 pages.

Notice of Allowance dated Jan. 9, 2019 in connection with U.S. Appl. No. 15/139,536, 10 pages.

* cited by examiner

ADJUSTABLE HELMET FOR A HOCKEY OR LACROSSE PLAYER

CROSS-REFERENCE TO RELATED APPLICATIONS

The present application is a continuation of U.S. patent application Ser. No. 15/139,536, filed Apr. 27, 2016, now pending, which is a continuation of U.S. patent application Ser. No. 13/548,622, filed Jul. 13, 2012, now U.S. Pat. No. 9,345,282, which claims the benefit of U.S. Provisional Patent Application No. 61/512,076, filed Jul. 27, 2011, and of U.S. Provisional Patent Application No. 61/587,040, filed Jan. 16, 2012, all of which are hereby incorporated by reference herein in their entireties.

FIELD OF THE INVENTION

The present invention relates to an adjustable helmet for a hockey or lacrosse player.

BACKGROUND OF THE INVENTION

Adjustable helmets made up of a front shell, a rear shell and fastening means are well known in the field of sports equipment, and especially in the field of hockey helmets.

U.S. Pat. No. 6,966,075 relates to an adjustable hockey helmet comprising: a back shell having a smooth interference-free sliding surface and two sides, wherein each side comprises two elongated slots and a series of anchoring holes, a front shell having a smooth interference-free sliding surface and two sides, wherein each side comprises a wing element adapted to overlap the interference-free sliding surface of the back shell, two slots and two anchoring holes. The front shell and the back shell are movably connected to each other by a peg inserted within the two elongated slots of the back shell and the two slots of the front shell. The helmet also comprises left and right manually operated locking devices. More particularly, the front shell has a left locking device mounted to the left wing and a right locking device mounted to the right wing. Each of the left and right locking devices has two teeth and is movable between a locked position and a released position. In the locked position, two teeth engage the two anchoring holes of the front shell and two holes of the series of holes of the back shell. In the released position, two teeth do not engage the series of anchoring holes of the back shell for allowing the front shell and the back shell to move in relation to each other.

Against this background, there is a need in the industry for an adjustable helmet where the player can move a single actuator between a first locked position, wherein the first and second shells define a first hollow space for receiving the player's head, a released position, wherein the first and second shells are moveable relative to one another, and a second locked position, wherein the first and second shells define a second hollow space for receiving the player's head, the second hollow space being different than the first hollow space. The single actuator is mounted on the top portion of the helmet such that use of two actuators on each side of the helmet is eliminated.

SUMMARY OF THE INVENTION

According to one aspect of the present invention, there is provided an adjustable helmet for receiving a head of a hockey or lacrosse player, the head having a crown region, left and right side regions, a top region, a back region and an occipital region, the helmet extending along a longitudinal axis and comprising: (a) a first shell having a first top portion for facing at least partially the top region of the player's head, a front portion for facing at least partially the crown region of the player's head, and left and right side portions extending rearwardly from the front portion for facing at least partially the left and right side regions of the player's head; (b) a second shell having a second top portion for facing at least partially the top region of the player's head, a rear portion for facing at least partially the back and occipital regions of the player's head, and left and right side portions extending forwardly from the rear portion for facing at least partially the left and right side regions of the player's head; and (c) a single actuator comprising at least one tooth extending substantially transversely relative to the longitudinal axis, the single actuator being mounted to one of the first and second top portions; wherein one of the first and second top portions comprises at least one aperture extending substantially transversely relative to the longitudinal axis and wherein the other one of the first and second top portions comprises a plurality of apertures extending substantially transversely relative to the longitudinal axis; wherein, in use, the single actuator is moveable by the player between: a first locked position, wherein the at least one tooth extends in the at least one aperture and in a first aperture of the plurality of apertures and wherein the first and second shells define a first hollow space for receiving the player's head; a released position, wherein the at least one tooth no longer extends in the at least one aperture and the plurality of apertures such that one of the first and second shells is moveable relative to the other of the first and second shells; and a second locked position, wherein the at least one tooth extends in the at least one aperture and in a second aperture of the plurality of apertures and wherein the first and second shells define a second hollow space for receiving the player's head, the second hollow space being different than the first hollow space.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of the embodiments of the present invention is provided herein below, by way of example only, with reference to the accompanying drawings, in which.

Figure 1:
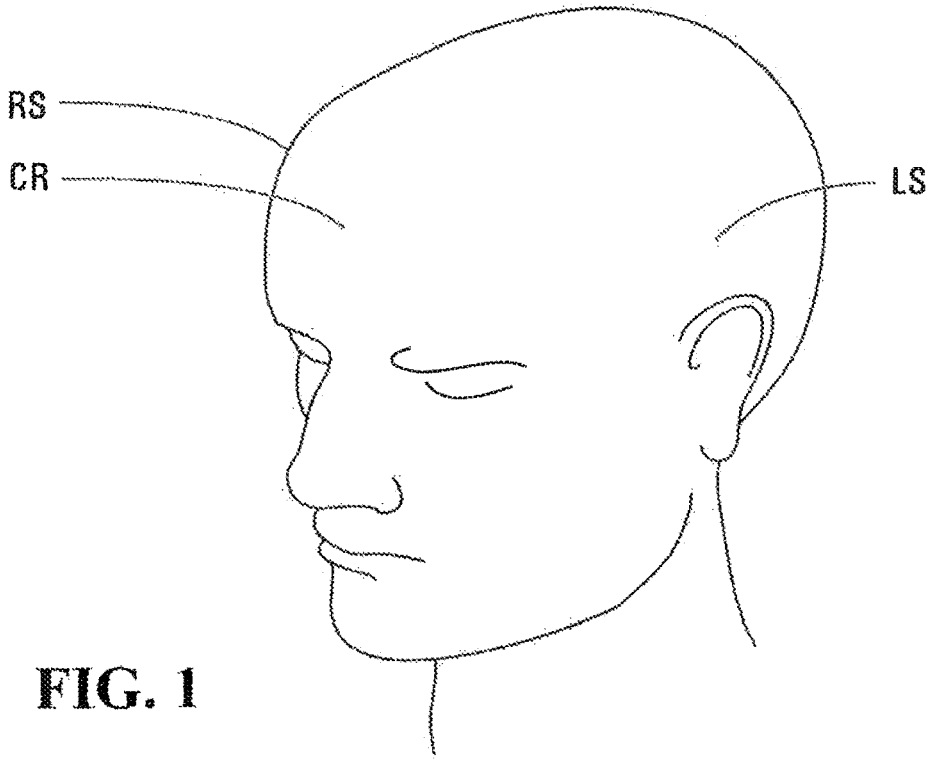
FIG. 1 is a perspective view of a head of a player.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
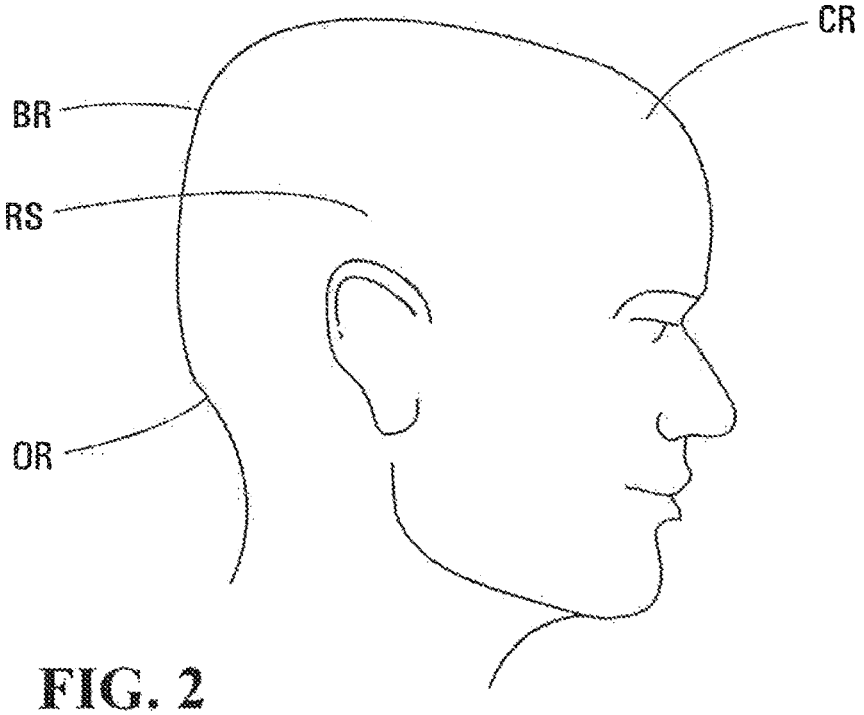
FIG. 2 is a right side elevational view of the head of the player of FIG. 1.

FIGS. 1 and 2 illustrate a head of a hockey or lacrosse player. The head comprises a crown region CR, left and right side regions LS, RS, a back region BR and an occipital region OR. The crown region CR has a front part that substantially corresponds to the forehead and a top part that substantially corresponds to the front top part of the head. In fact, the crown region CR generally corresponds to the frontal bone region of the head. The left and right side regions LS, RS are approximately located above the ears of the player. The occipital region OR substantially corresponds to the region around and under the external occipital protuberance of the head.

Figure 3:
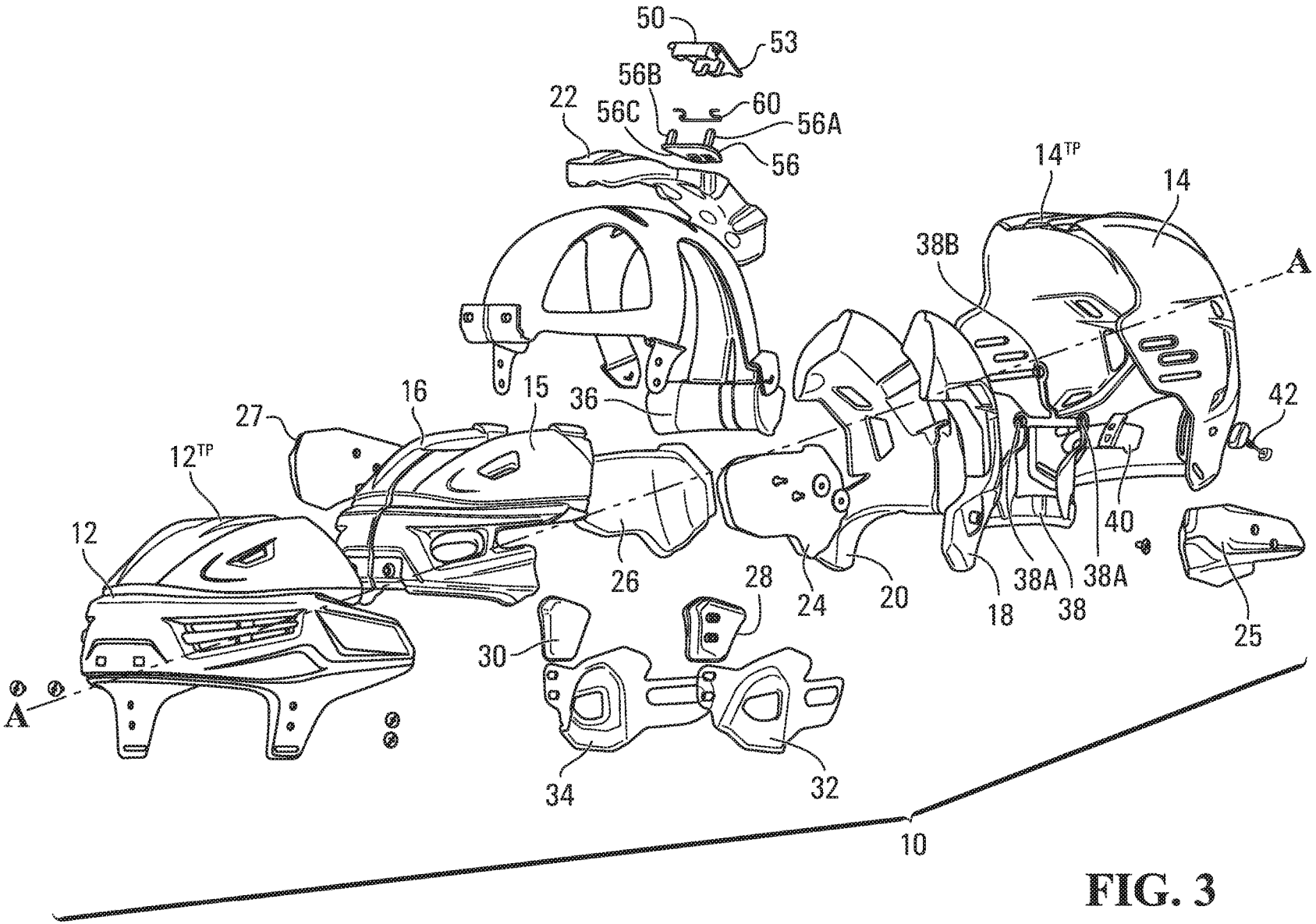
FIG. 3 is a front perspective exploded view of a helmet constructed in accordance with an embodiment of the invention.
Figure 4:
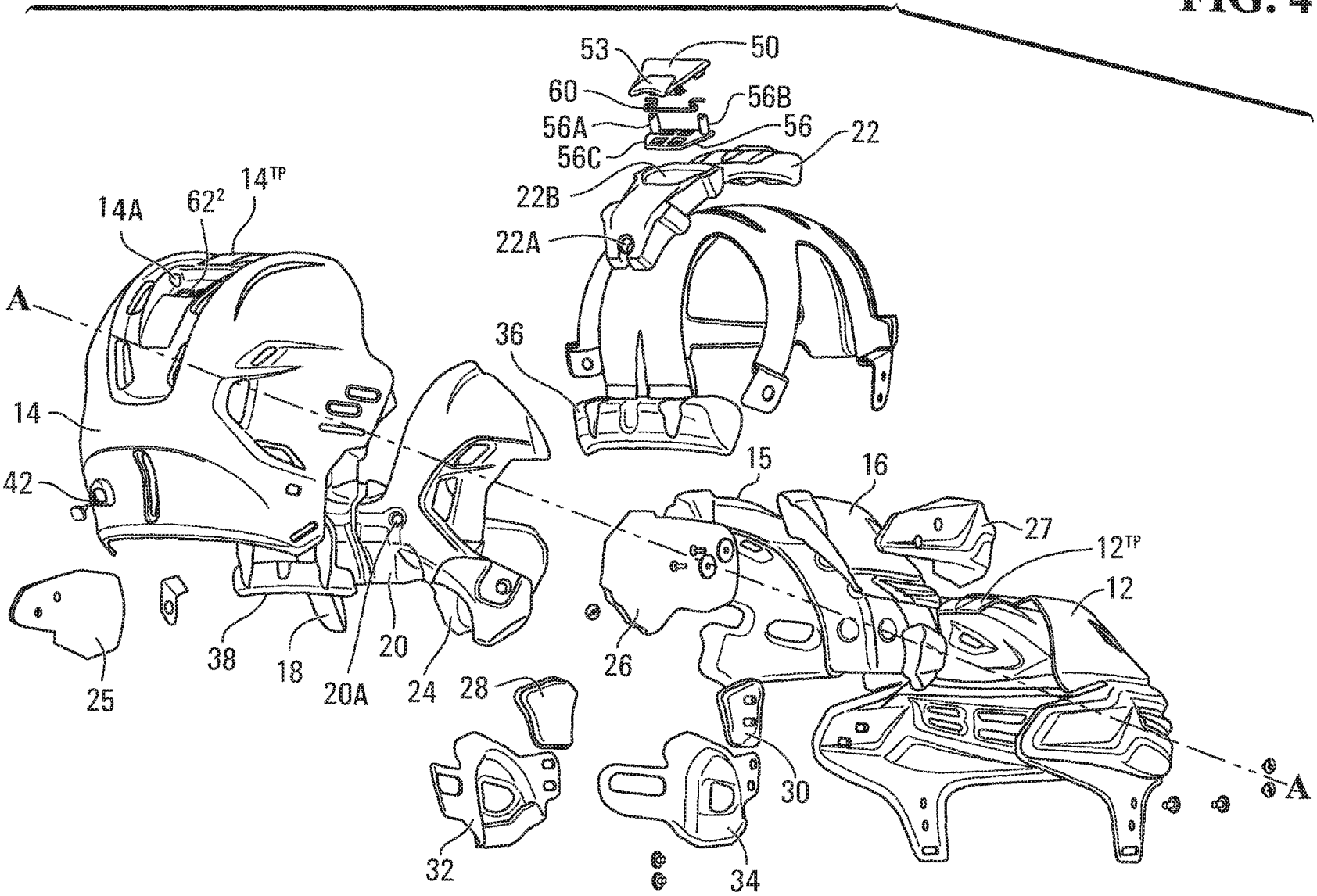
FIG. 4 is a rear perspective exploded view of the helmet of FIG. 3.

FIGS. 3 and 4 show an adjustable helmet 10 for receiving the head of the hockey or lacrosse player. The helmet 10 extends along a longitudinal axis A-A and comprises a first shell 12 and a second shell 14 interconnected together. As shown, the first shell 12 may be a front shell and the second shell 14 may be a rear shell. The first shell 12 and second shell 14 may be made of a relatively rigid material, such as polyethylene, NYLON, polycarbonate materials, thermoplastics, or thermosetting resins or any other suitable material. The first and second shells 12, 14 include a plurality of ventilation apertures that provide the added comfort of allowing air to circulate around the head of the player.

The first shell 12 has a first top portion $\mathbf{12}^{TP}$ for facing at least partially the top region of the player's head, a front portion for facing at least partially the crown region of the player's head, and left and right side portions extending rearwardly from the front portion for facing at least partially the left and right side regions of the player's head.

The second shell 14 has a second top portion $\mathbf{14}^{TP}$ for facing at least partially the top region of the player's head, a rear portion for facing at least partially the back and occipital regions of the player's head, and left and right side portions extending forwardly from the rear portion for facing at least partially the left and right side regions of the player's head. As shown the first top portion $\mathbf{12}^{TP}$ may be a front top portion and the second top portion $\mathbf{14}^{TP}$ may be a rear top portion.

The first shell 12 overlays left and right front inner pads 15, 16 while the second shell 14 overlays left and right rear inner pads 18, 20 and a top inner pad 22. The left and right front inner pads 15, 16 face the crown region CR and face at least partially the left and right side regions LS, RS. The left and right rear inner pads 18, 20 face the back region BR and face at least partially the left and right side regions LS, RS. The top inner pad 22 faces the back and top regions of the head. The inner pads 16, 18, 20, 22 may be made of shock absorbing materials such as expanded polypropylene (EPP) or expanded polyethylene (EPE). Other materials can also be used without departing from the spirit of the invention.

The left and right front inner pads 15, 16 have a three-dimensional external configuration that matches the three-dimensional internal configurations of the first shell 12 and is mounted to the first shell 12 by any suitable means such glue, stitches, tacks, staples or rivets. Similarly, the left and right rear inner pads 18, 20 have three-dimensional external configurations that match the three-dimensional internal configurations of the second shell 14 and are mounted to the second shell 14 by any suitable means, such as glue, stitches, tacks, staples or rivets.

The helmet 10 may also comprise left and right comfort pads 24, 26 facing the left and right side regions and located just above the ears and left and right comfort pads 28, 30 facing the left and right temple regions of the head. The helmet 10 may further comprise left and right comfort pads 25, 27 facing the left and right side regions and located just above the ears and between the first and second shells 12, 14. The comfort pads 24, 25, 26, 27, 28, 30 may be made of soft materials such as polyvinyl chloride (PVC). Other materials can also be used without departing from the spirit of the invention. The comfort pads 24, 25, 26, 27, 28, 30 may be affixed on the inner surface of the corresponding inner pads or shells by any suitable means, such as glue or an adhesive layer.

The helmet 10 may comprise left and right ear covers 32, 34 for protecting the ears of the player.

The helmet 10 may also comprise an occipital pad 36 facing the occipital region OR of the player's head and movable relative to the second shell 14 between different positions to adjust the fit of the helmet 10 on the player's head.

The occipital pad 36 may be made of any suitable padding material. For example, in some embodiments, the occipital pad 36 may comprise polymeric foam such as expanded polypropylene (EPP) foam, expanded polyethylene (EPE) foam, foam having two or more different densities (e.g., high-density polyethylene (HDPE) foam and low-density polyethylene foam), or any other suitable foam. Other materials may be used for the occipital pad 36 in other embodiments.

As best shown in FIG. 4, the occipital pad 36 is supported by a support 38 which is movable relative to the second shell 24 in order to move the occipital pad 36. A wedge 40 (best shown in FIG. 3) is located between the second shell 14 and the support 38 and connected to an actuator 42 such that, when the player operates the actuator 42, the wedge 40 moves between different positions relative to the second shell 14 and the support 38. The wedge 40 has a thickness that increases gradually from its top edge to its bottom edge such that downward vertical displacement of the wedge 40 between the second shell 14 and the support 38 moves the occipital pad 36 from a first position towards a second position in which it applies a greater pressure upon the occipital region OR of the player's head. Movement of the occipital pad 36 allows it to be positioned in a first position in which it is closer to the back portion of the second shell 14 and in a second position in which it is further inward of the helmet 10 and closer to the occipital region OR to apply more pressure on the occipital region OR than in its first position.

As best shown in FIGS. 3 and 4, the support 38 may have an upper portion with left and right connectors, projections or pins 38A that are received in apertures provided in the rear inner pads 18, 20 (see aperture 20A) such that the support is mounted to the rear inner pads 18, 20. The upper portion of the support 38 may also comprise a member extending upwardly with a connector, projection or pin 38B that is received in an aperture 22A provided in the top inner pad 22 such that the top inner pad 22 is only affixed at that point to the second shell 14.

The helmet 10 also comprises a single actuator 50 comprising at least one tooth extending substantially transversely relative to the longitudinal axis A-A.

Figure 8:
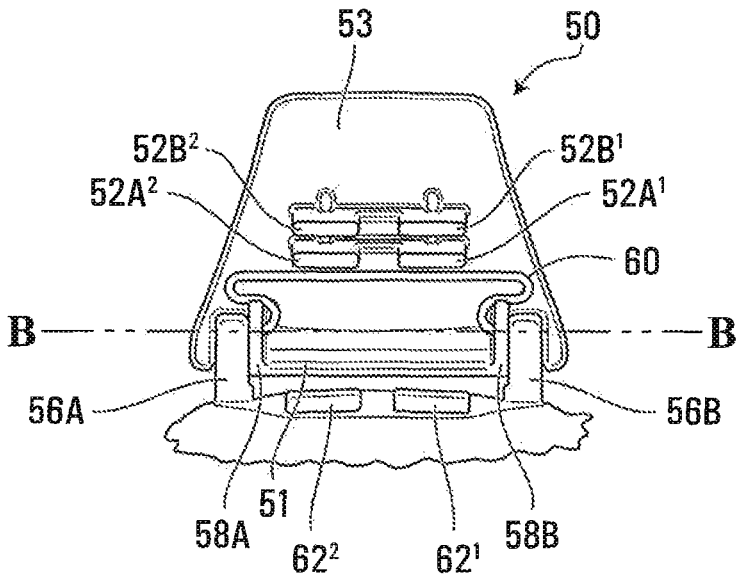
FIG. 8 is an enlarged rear elevational view of the single actuator shown in a released position.
Figure 9A:
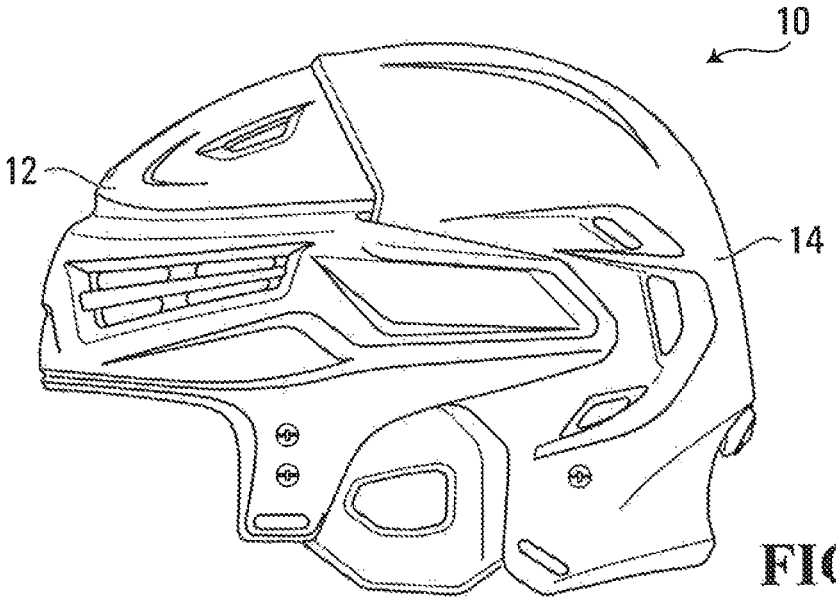
FIG. 9A is a side view of the helmet of FIG. 3, with the single actuator in a first locked position, wherein the first and second shells define a first hollow space for receiving the player's head.
Figure 9B:
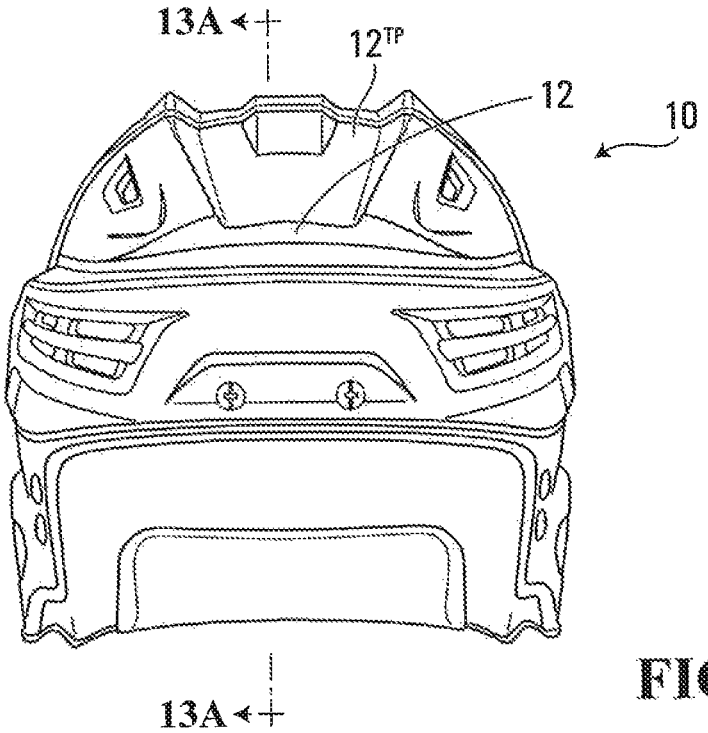
FIG. 9B is a front view of the helmet corresponding to the position shown in FIG. 9A.
Figure 10A:
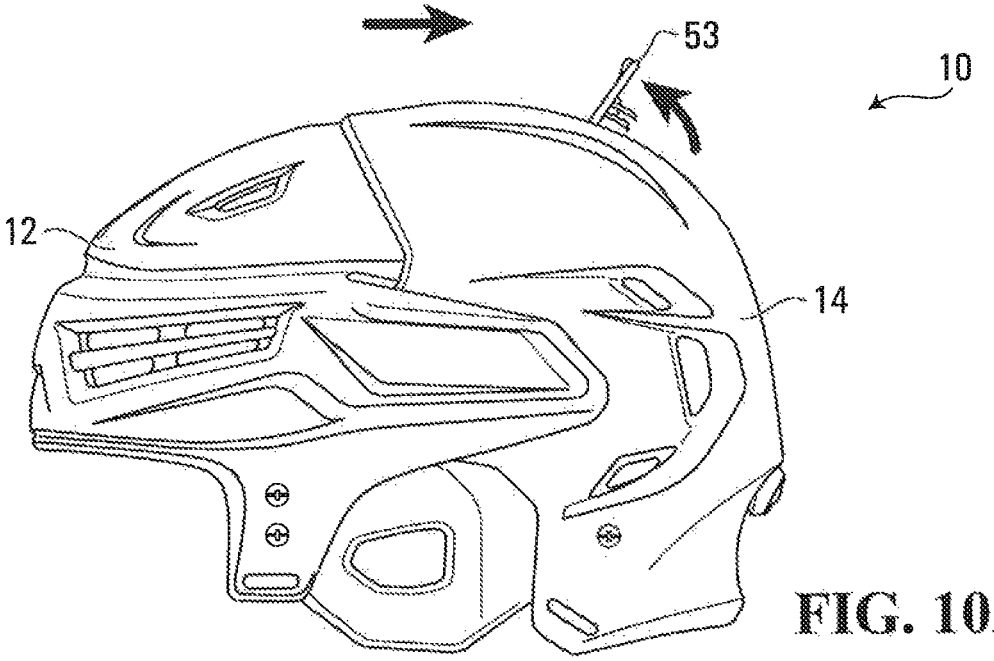
FIG. 10A is a side view of the helmet of FIG. 3, with the single actuator shown in a released position and showing movement of the back shell relative to the first shell.
Figure 10B:
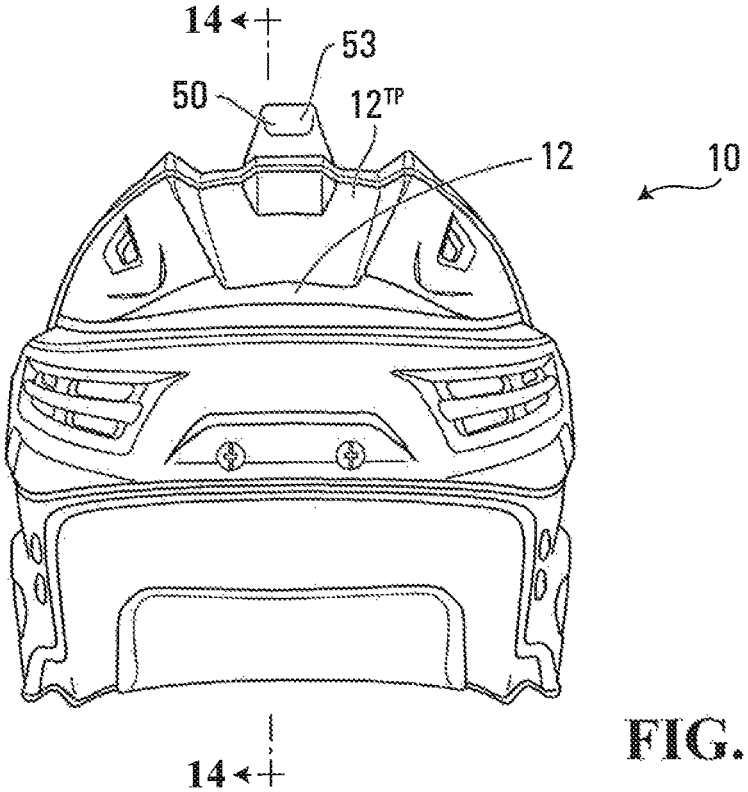
FIG. 10B is a front view of the helmet corresponding to the position shown in FIG. 10A.
Figure 11A:
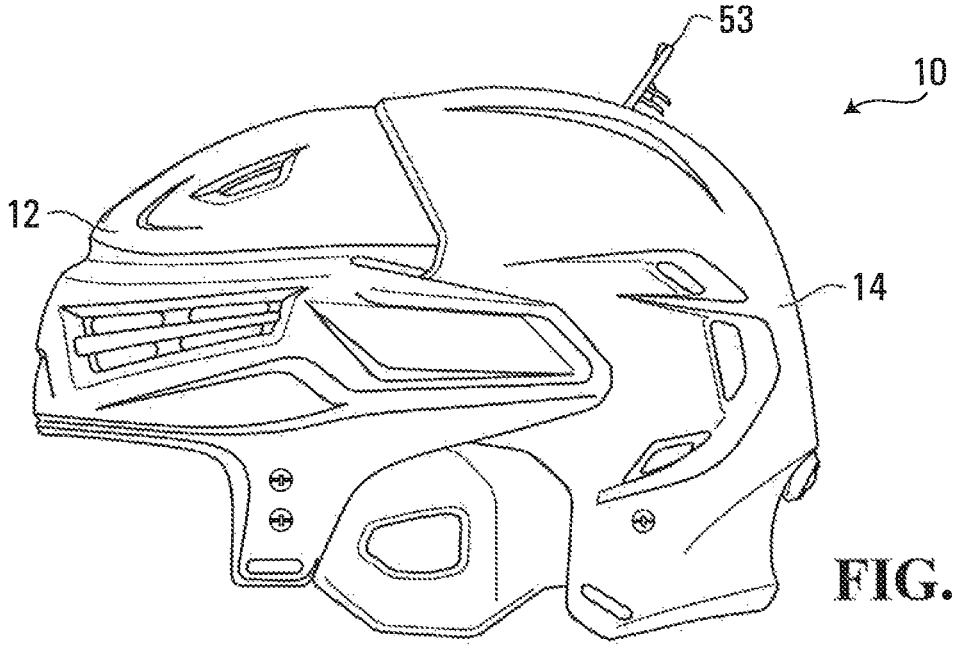
FIG. 11A is a side view of the helmet of FIG. 3, with the single actuator in the released position.
Figure 11B:
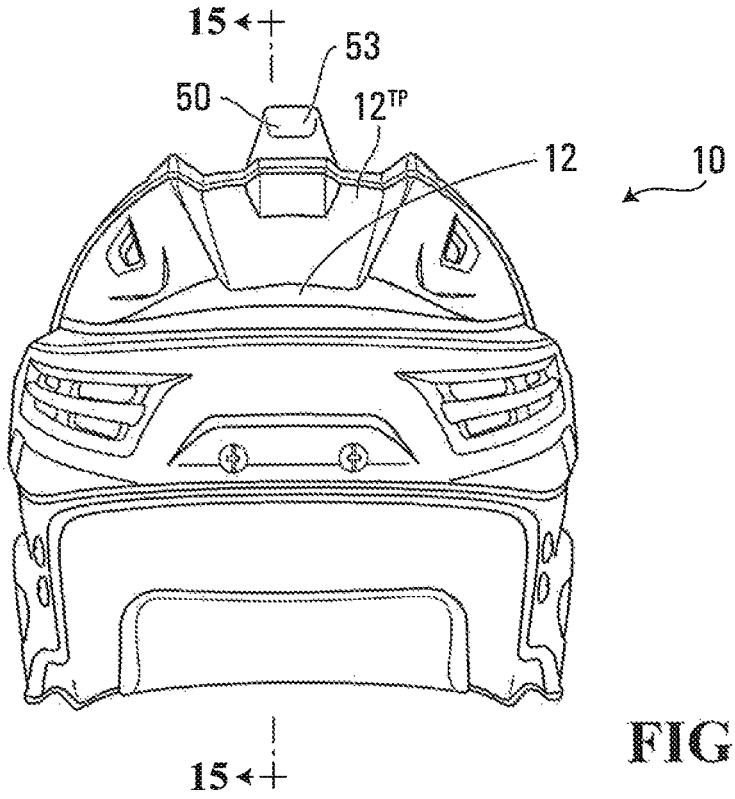
FIG. 11B is a front view of the helmet corresponding to the position shown in FIG. 11A.
Figure 12A:
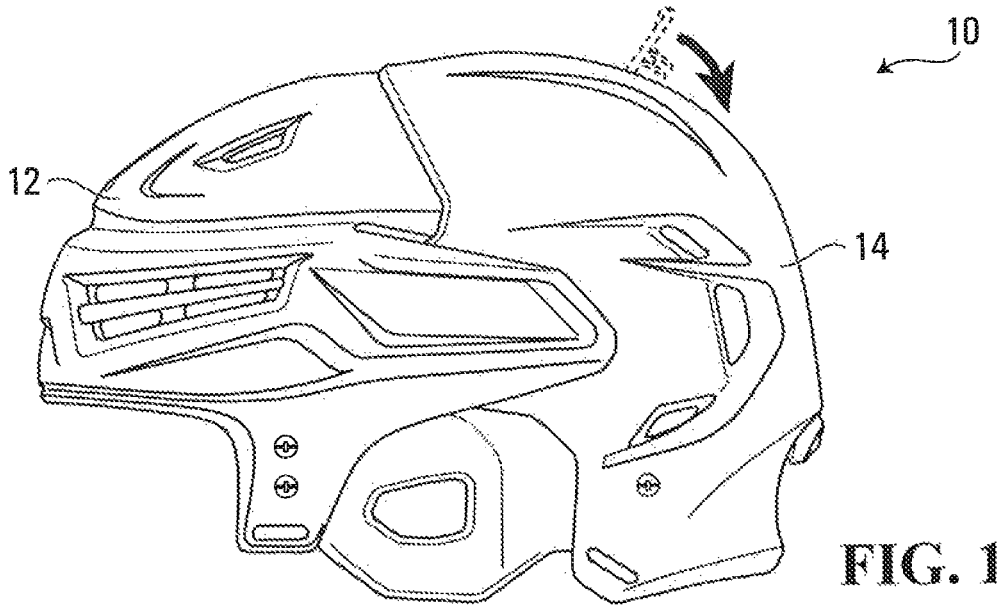
FIG. 12A is a side view of the helmet of FIG. 3, with the single actuator in a second locked position, wherein the first and second shells define a second hollow space for receiving the player's head.
Figure 12B:
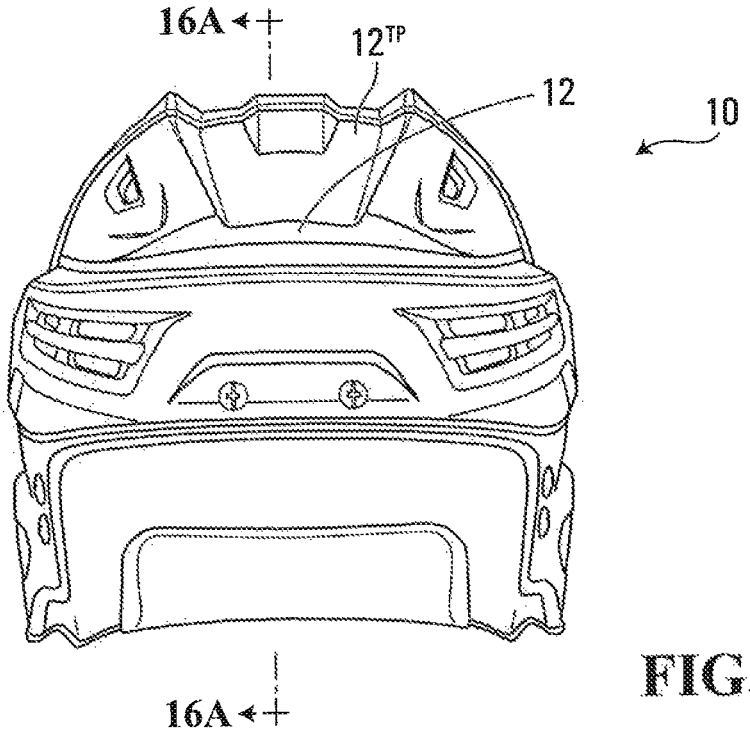
FIG. 12B is a front view of the helmet corresponding to the position shown in FIG. 12A.
Figure 16A:
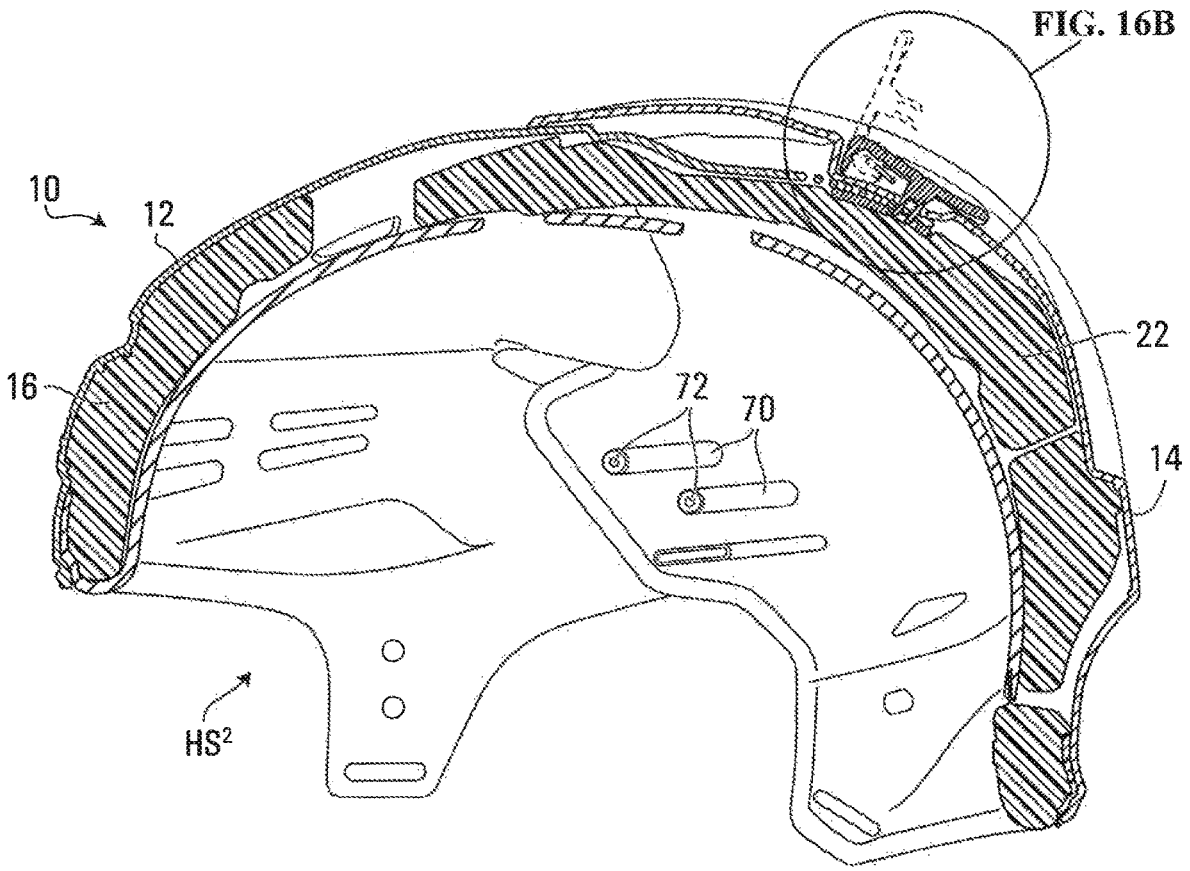
FIG. 16A is an enlarged cross-sectional view of the helmet of FIG. 12B taken along line 16A-16A.
Figure 16B:
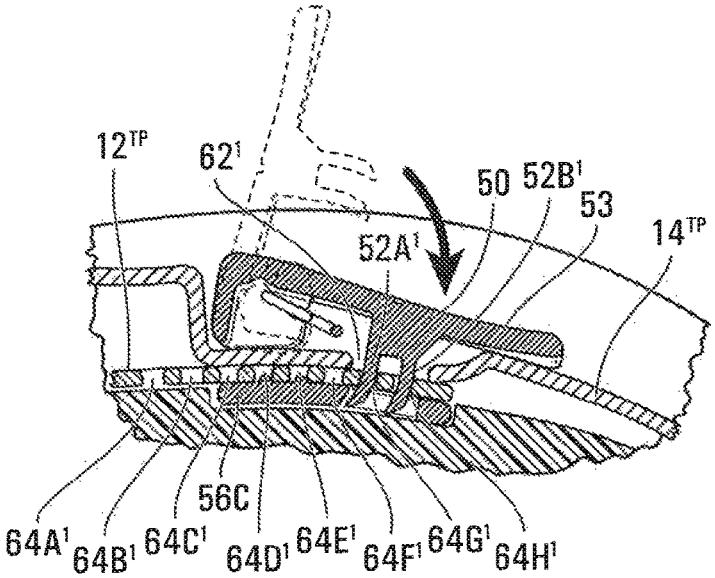
FIG. 16B is an enlarged cross-sectional view showing the single actuator in the released position in broken lines and the single actuator in the second locked position in full lines.
Figure 17:
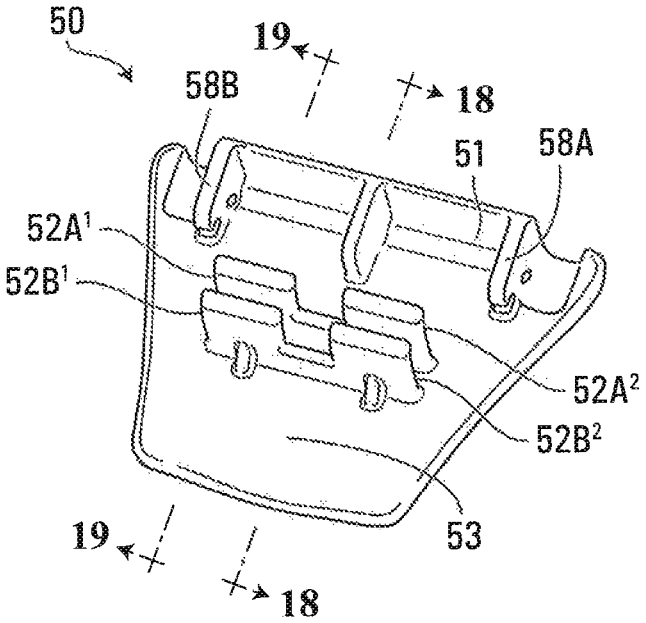
FIG. 17 is an enlarged bottom perspective view of the actuator.
Figure 18:
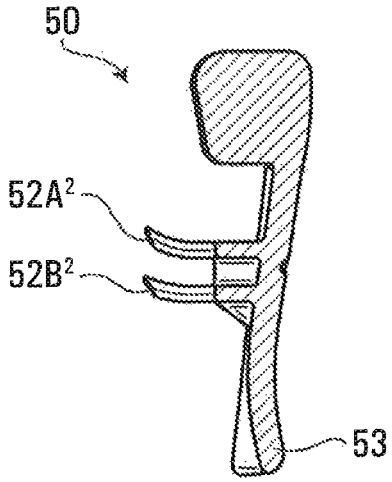
FIG. 18 is a cross-sectional view of the actuator of FIG. 17 taken along line 18-18.

As best seen in FIGS. 8 and 17, the single actuator 50 has a cam member 51 adapted to pivot about an axis B-B that extends substantially transversely relative to the longitudinal axis A-A and the single actuator 50 extends from the cam member 51 and has a handle 53 for allowing the player to move the single actuator 50 between a first locked position (shown in FIG. 13B), a released position (shown in FIG. 14) and a second locked position (shown in full lines in FIG. 16B). The handle 53 may have a curved or recessed portion for allowing movement or rotation of the single actuator 50 by the player with only one finger or with only the thumb.

The single actuator 50 may comprise a first pair of first and second teeth 52A$^1$, 52A$^2$ being spaced apart and a second pair of first and second teeth 52B$^1$, 52B$^2$ being spaced apart. Each of the first and second teeth 52A$^1$, 52A$^2$ and first and second teeth 52B$^1$, 52B$^2$ extend substantially transversely relative to the longitudinal axis A-A (or along an axis substantially parallel to the axis B-B).

Figure 20:
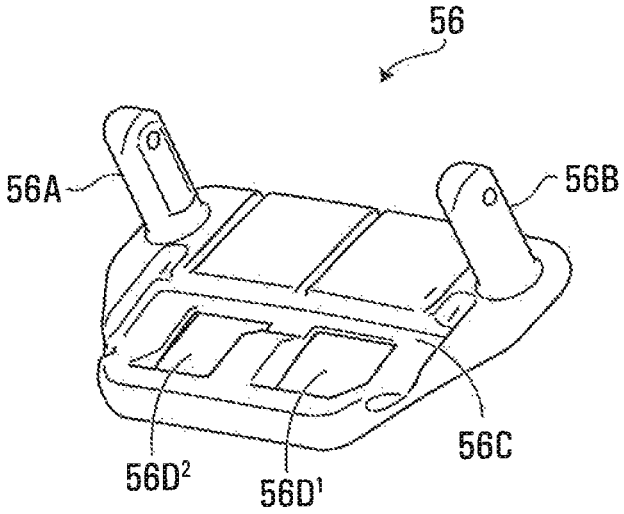
FIG. 20 is an enlarged top perspective view of a base member.

The single actuator 50 is mounted to one of the first and second top portions 12$^{TP}$, 14$^{TP}$. For example, the second top portion 14$^{TP}$ may comprise first and second posts 56A, 56B and the single actuator 50 may be pivotally mounted relative to the first and second posts 56A, 56B. The first and second posts 56A, 56B may be integrally formed with the second top portion 14$^{TP}$. Alternatively, as best shown in FIGS. 3, 4 and 20, the first and second posts 56A, 56B may be part of a base member 56 and the first and second posts 56A, 56B may extend in apertures 14A, 14B provided in the second top portion 14$^{TP}$ (see FIG. 5B). The base member 56 may also have a base 56C with first and second apertures 56D$^1$, 56D$^2$ (see FIG. 20).

Reverting to FIG. 8, the single actuator 50 may have first and second walls 58A, 58B abutting against the first and second posts 56A, 56B respectively and a wire 60 may slide through holes provided in the first and second walls 58A, 58B and first and second posts 56A, 56B. In one embodiment, the wire 60 may be a wire clip in the shape of a dovetail with both of its ends exerting an external force when it is inserted in the holes. This ensures that the wire 60 will not fall out accidentally, since it would need to be manually compressed in order to be removed.

One of the first and second top portions 12$^{TP}$, 14$^{TP}$ comprises at least one aperture extending substantially transversely relative to the longitudinal axis A-A and the other one of the first and second top portions 12$^{TP}$, 14$^{TP}$ comprises a plurality of apertures extending substantially transversely relative to the longitudinal axis A-A.

Referring to FIGS. 5A, 5B, 13B and 16B, the second top portion 14$^{TP}$ has a pair of first and second apertures 62$^1$, 62$^2$ being spaced apart. It is understood that the first and second apertures 62$^1$, 62$^2$ may be replaced by one aperture or opening that is large enough for receiving the first pair of first and second teeth 52A$^1$, 52A$^2$ and second pair of first and second teeth 52B$^1$, 52B$^2$. The first top portion 12$^{TP}$ has a plurality of pairs of first and second apertures 64A$^1$, 64A$^2$; 648$^1$, 64B$^2$; 64C', 64C$^2$; 64D$^1$, 64D$^2$; 64E$^1$, 64E$^2$; 64F$^1$, 64F$^2$; 64G$^1$, 64G$^2$; 64H$^1$, 64H$^2$, More specifically, in one embodiment, the first top portion 12$^{TP}$ may have a first and second series of eight apertures extending substantially transversely relative to the longitudinal axis A-A, the first and second series of apertures being spaced apart.

Figure 13A:
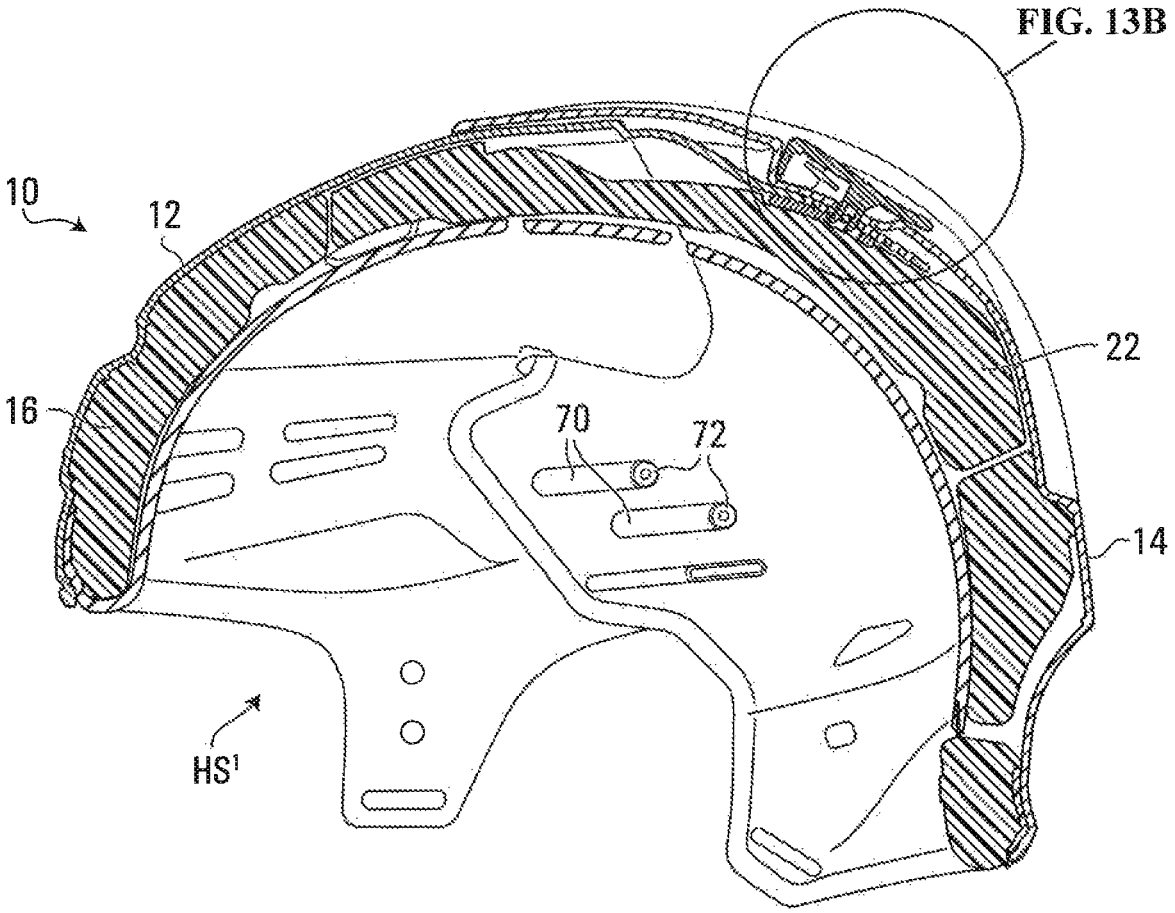
FIG. 13A is an enlarged cross-sectional view of the helmet of FIG. 9B taken along line 13A-13A.
Figure 13B:
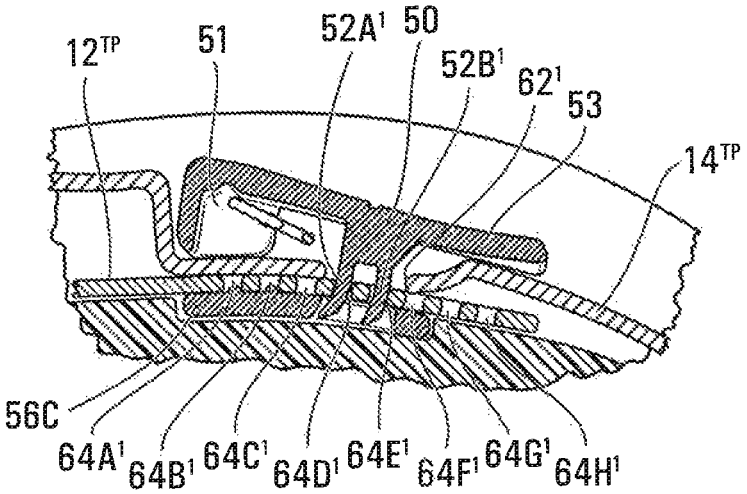
FIG. 13B is an enlarged cross-sectional view showing the single actuator in the first locked position.

Referring to FIG. 13B showing the single actuator 50 in the first locked position, the first tooth 52A' and the first tooth 52B$^1$ extend in the first aperture 62$^1$. The first tooth 52A$^1$ and the first tooth 52B$^1$ also extend in first apertures of the plurality of first apertures 64A$^1$, 64B$^1$, 64C$^1$, 64D$^1$, 64E$^1$, 64F$^1$, 64G$^1$, 64H$^1$ (more specifically, the first tooth 52A$^1$ and the first tooth 52B$^1$ extend in apertures 64D$^1$, 64E$^1$). It is understood that the second tooth 52A$^2$ and the second tooth 52B$^2$ also extend in the second aperture 62$^2$ and the second tooth 52A$^2$ and the second tooth 52B$^2$ also extend in first apertures of the plurality of second apertures 64A$^2$, 64B$^2$, 64C$^2$, 64D$^2$, 64E$^2$, 64F$^2$, 64G$^2$, 64H$^2$ (more specifically, the second tooth 52A$^2$ and the second tooth 52B$^2$ extend in apertures 64D$^2$, 64E$^2$). It is also understood that the first pair of first and second teeth 52A$^1$, 52A$^2$ and second pair of first and second teeth 52B$^1$, 52B$^2$ may extend in the first and second apertures 56D$^1$, 56D$^2$ of the base member 56. It is understood that the first and second apertures 56D$^1$, 56D$^2$ may be replaced by one aperture or opening that is large enough for receiving the first pair of first and second teeth 52A$^1$, 52A$^2$ and second pair of first and second teeth 52B$^1$, 52B$^2$.

In the first locked position, the first and second shells 12, 14 define a first hollow space HS$^1$ for receiving the player's head.

The single actuator 50 is movable to a released position, wherein the at least one tooth no longer extends in the at least one aperture and the plurality of apertures such that one of the first and second shells 12, 14 is moveable relative to the other of the first and second shells 12, 14.

Figure 14:
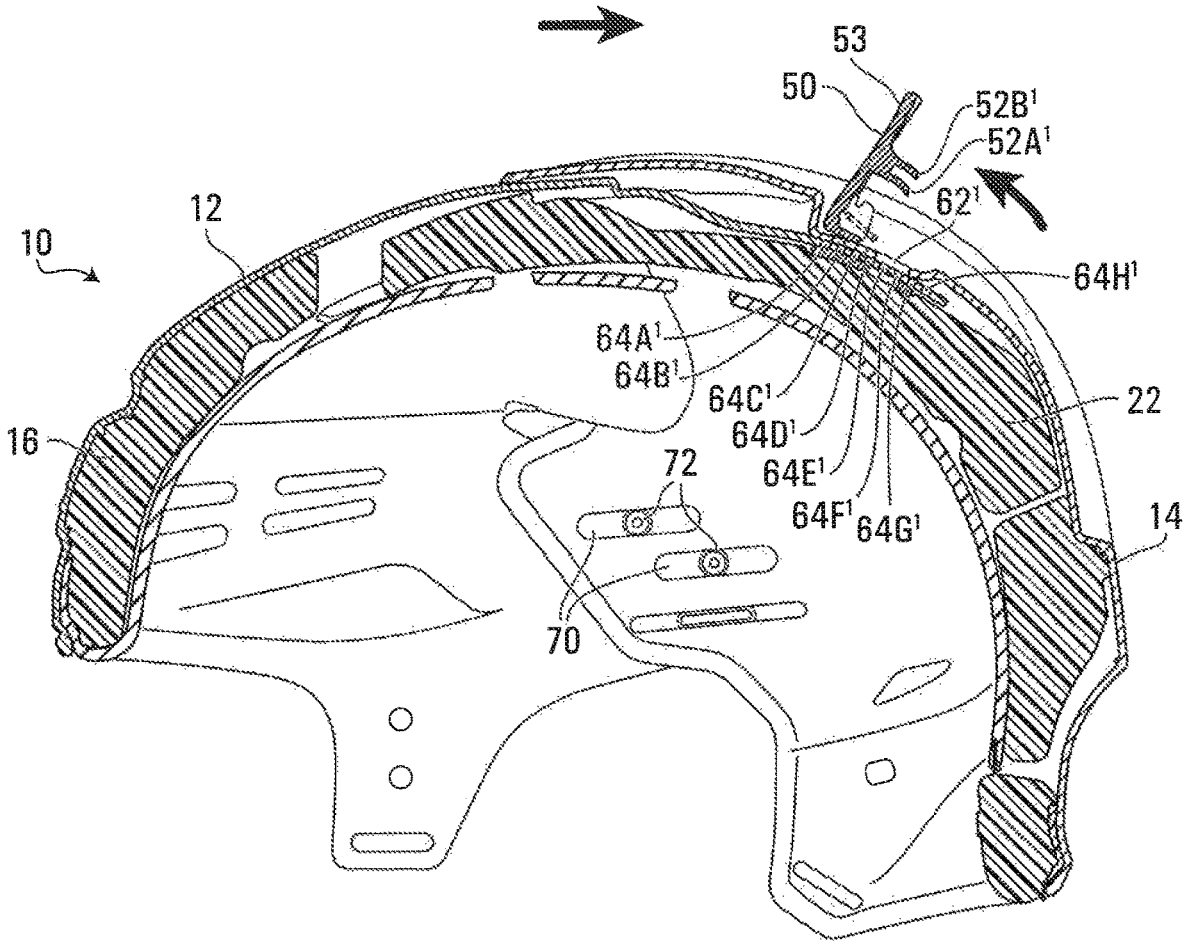
FIG. 14 is an enlarged cross-sectional view of the helmet of FIG. 10B taken along line 14-14.
Figure 15:
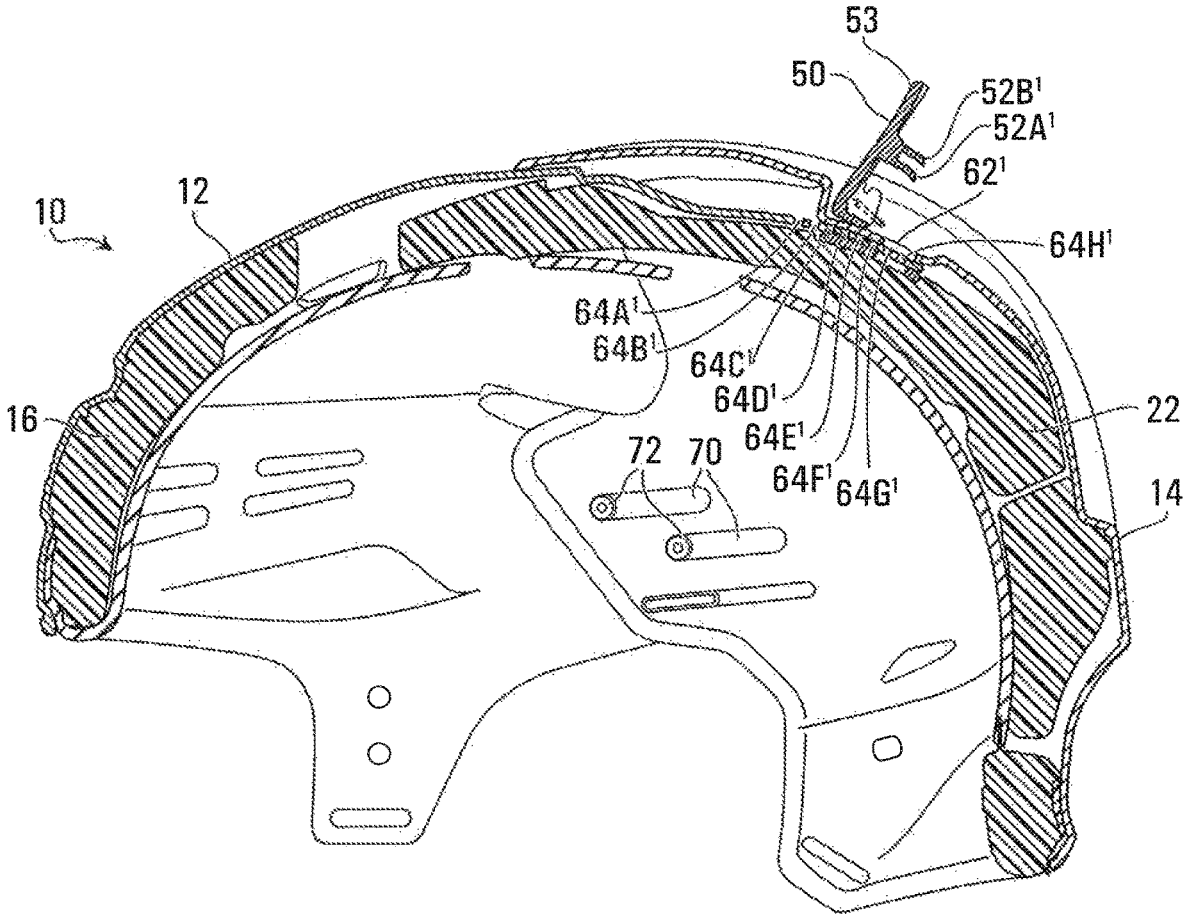
FIG. 15 is an enlarged cross-sectional view of the helmet of FIG. 11B taken along line 15-15.

As best shown in FIG. 14, the first tooth 52A$^1$ and the first tooth 52B$^1$ no longer extend in the first aperture 62$^1$ and the first tooth 52A$^1$ and the first tooth 52B$^1$ no longer extend in the first apertures of the plurality of first apertures 64A$^1$, 64B$^1$, 64C$^1$, 64D$^1$, 64E$^1$, 64F$^1$, 64G$^1$, 64H$^1$ (which were apertures 64D$^1$, 64E$^1$) such that one of the first and second shells 12, 14 is moveable relative to the other of the first and second shells 12, 14. It is understood that the second tooth 52A$^2$ and the second tooth 52B$^2$ also no longer extend in the second aperture 62$^2$ and the second tooth 52A$^2$ and the second tooth 52B$^2$ also no longer extend in the first apertures of the plurality of second apertures 64A$^2$, 64B$^2$, 64C$^2$, 64D$^2$, 64E$^2$, 64F$^2$, 64G$^2$, 64H$^2$ (which were apertures 64D$^2$, 64E$^2$).

Figure 6:
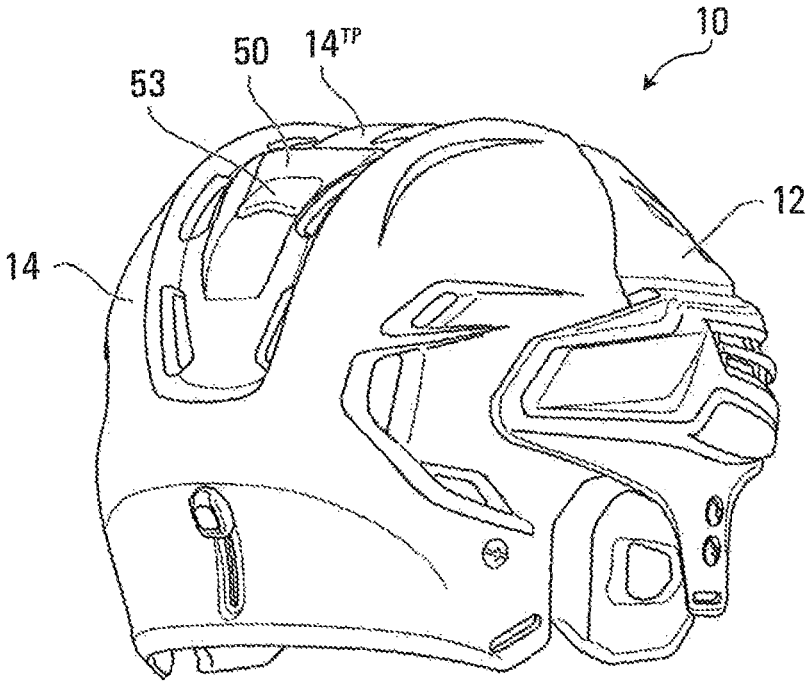
FIG. 6 is a rear side perspective view of the helmet of FIG. 3.
Figure 7:
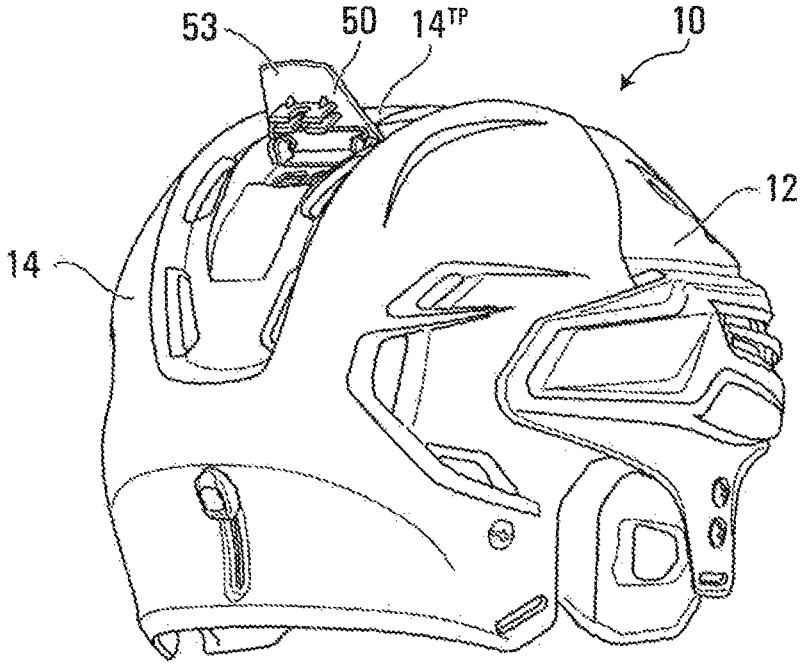
FIG. 7 is a rear side perspective view of the helmet of FIG. 3, with the single actuator shown in a released position.

In use, a player who puts on the helmet 10 and realizes that it is too large or too small, does not need to remove the helmet 10. The player must simply reach up and grasp the single actuator 50 (the handle 53) and rotate the actuator 50. As best shown in FIGS. 6 and 7, the single actuator 50 is mounted to the second top portion 14$^{TP}$ and is pivotable about an axis that extends substantially transversely relative to the longitudinal axis A-A (or along an axis substantially parallel to the axis B-B shown in FIG. 8) and the single actuator 50 is also located at a central location where it overlies the longitudinal axis A-A such that the player can easily reach up the single actuator 50 (the handle 53) in order to rotate the single actuator 50 with the thumb or with only one finger and bring the single actuator 50 in the released position shown in FIGS. 7 and 14.

Because the helmet 10 has a single actuator, namely the actuator 50, the player can actuate, move or rotate the single actuator 50 with only one hand as opposed to using both hands as required by prior helmets wherein left and right locking devices are located on both sides of the helmet. By providing the single actuator 50 on one of the first and second top portions 12$^{TP}$, 14$^{TP}$, this allows to reduce the manufacturing cost and the number of components of the helmet. Moreover, because actuators on the left and right sides of the helmet are eliminated, those sides may be designed as being thinner such that the helmet may be generally less bulky.

Once the single actuator 50 is in the released position, the player can expand or contract the size of the helmet 10 by pushing or pulling the first and second shells 12, 14 in relation to each other. As shown in FIG. 14, the second shell 14 is pushed rearwardly in order to increase the size of the hollow cavity defined by the first and second shells 12, 14.

Figure 5A:
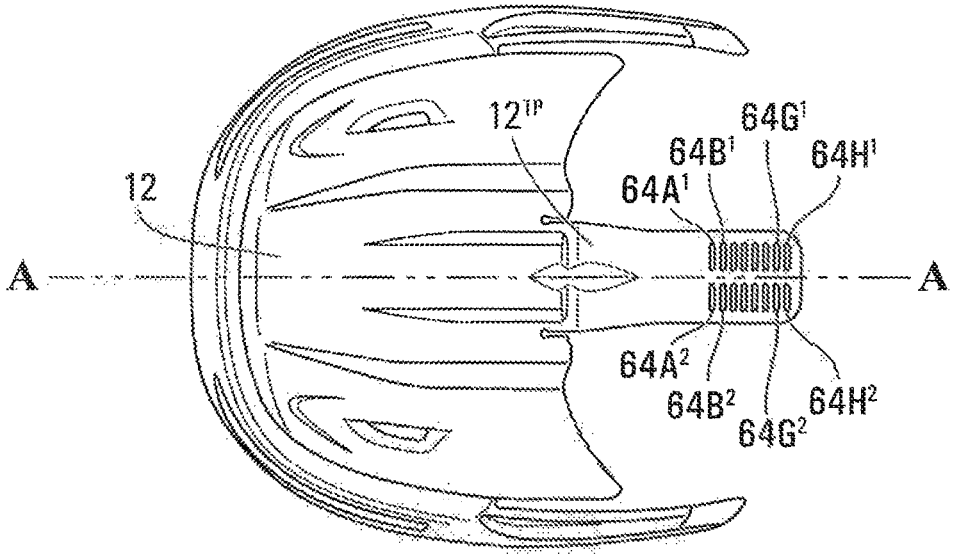
FIG. 5A shows a top view of the first shell of the helmet of FIG. 3.
Figure 5B:
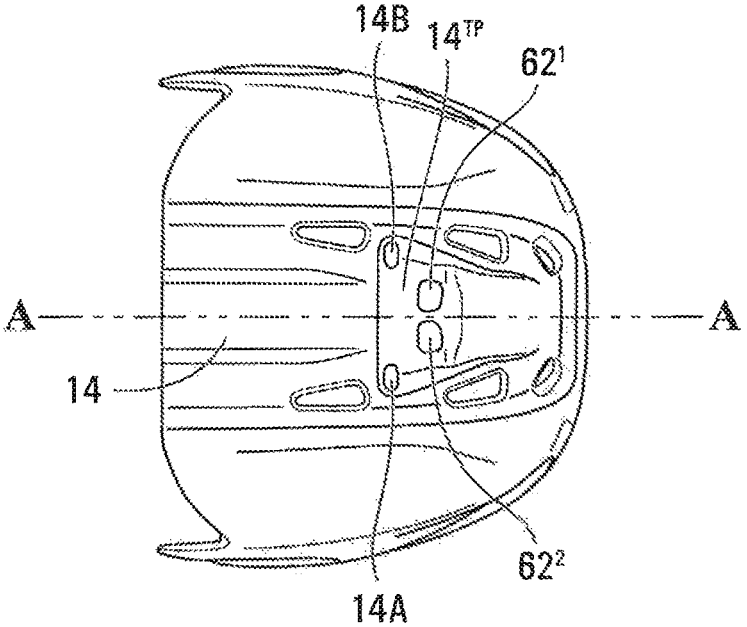
FIG. 5B shows a top view of the second shell of the helmet of FIG. 3.

As indicated previously, the top inner pad 22 is only affixed to the second shell 14 at only one point (connector 38B best seen in FIG. 3). The upper surface of the top inner pad 22 may also comprise a recess 22B for at least partially receiving the base 56C of the base member 56 and the top inner pad 22, base member 56 and actuator 50 thus move with the second shell 14 when the first and second shells 12, 14 move relative to each other. Moreover, as best seen in FIGS. 5A, 13B and 16B, the first top portion 12$^{TP}$ may define a band, strip or extension extending generally rearwardly along the axis A-A and being at least partially located between the second top portion 14$^{TP}$ and the base 56C of the base member 56. The bottom surface of the second top portion 14$^{TP}$ may also comprise a channel or a rectangular opening for at least partially receiving the first top portion extension.

Once the player has selected a desired helmet size, the first shell 12 and second shell 14 must be securely locked in place so that movement of the first and second shells 12, 14 in relation to each other is prevented. The player must then actuate (rotate) the actuator 50 such that this actuator is in a second locked position, wherein the at least one tooth extends in the at least one aperture and in a second aperture of the plurality of apertures.

Referring to FIG. 16B showing the single actuator 50 in the second locked position, the first tooth 52A$^1$ and the first tooth 52B$^1$ extend in the first aperture 62$^1$. The first tooth 52A$^1$ and the first tooth 52B$^1$ also extend in second apertures of the plurality of first apertures 64A$^1$, 64B$^1$, 64C$^1$, 64D$^1$, 64E$^1$, 64F$^1$, 64G$^1$, 64H$^1$ (more specifically, the first tooth 52A$^1$ and the first tooth 52B$^1$ extend in apertures 64G', 64H$^1$). It is understood that the second tooth 52A$^2$ and the second tooth 52B$^2$ also extend in the second aperture 62$^2$ and the second tooth 52A$^2$ and the second tooth 52B$^2$ also extend in second apertures of the plurality of second apertures 64A$^2$, 64B$^2$, 64C$^2$, 64D$^2$, 64E$^2$, 64F$^2$, 64G$^2$, 64H$^2$ (more specifically, the second tooth 52A$^2$ and the second tooth 52B$^2$ extend in apertures 64G$^2$, 64H$^2$).

In the second locked position, the first and second shells 12, 14 define a second hollow space HS$^2$ for receiving the player's head. As best shown in FIGS. 13A and 16A, the second hollow space HS$^2$ is different (larger) that the first hollow space HS$^1$.

It is understood that either of the first pair of teeth 52A$^1$, 52A$^2$ or the second pair of teeth 52B$^1$, 52B$^2$ may be omitted such that the single actuator 50 has only one pair of teeth. It is also understood that the single actuator 50 may only have one tooth extending along the width of the actuator 50 instead of a pair of first and second teeth being spaced apart or instead of the first pair of first and second teeth 52A$^1$, 52A$^2$ and the second pair of first and second teeth 52B$^1$, 52B$^2$. Similarly, it is understood that the second top portion 14$^{TP}$ may have one single aperture instead of the pair of first and second apertures 62$^1$, 62$^2$ and the first top portion 12$^{TP}$ may have a plurality of single apertures instead of the plurality of pairs of first and second apertures 64A$^1$, 64A$^2$; 64B$^1$, 64B$^2$; 64C$^1$, 64C$^2$; 64D$^1$, 64D$^2$; 64E$^1$, 64E$^2$; 64F$^1$, 64F$^2$;

64G$^1$, 64G$^2$; 64H$^1$, 64H$^2$.

If the single actuator 50 has only one tooth, in the first locked position, this tooth extends in the single aperture of the second top portion 14$^{TP}$ and in a first aperture of the plurality of apertures of the first top portion 12$^{TP}$, and in the second locked position, this tooth extends in the single aperture of the second top portion 14$^{TP}$ and in a second aperture of the plurality of apertures of the first top portion 12$^{TP}$.

Figure 19:
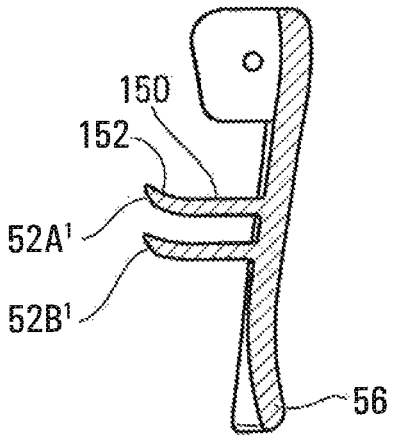
FIG. 19 is a cross-sectional view of the actuator of FIG. 17 taken along line 19-19.

It is understood that the width and thickness of the tooth (e.g. first and second teeth 52A$^1$, 52A$^2$) are determined such that the tooth is tightly received in its corresponding aperture of the series of apertures (e.g. apertures 64$A^1$, 64$B^1$, 64$C^1$, 64$D^1$, 64$E^1$, 64$F^1$, 64$G^1$, 64$H^1$) in order to prevent movement of the first and second shells 12, 14 relative to each other. The tooth should therefore tightly register, extend or fit in its corresponding aperture of the series of apertures when the actuator is in the first or second locked position. Moreover, the width, thickness and/or length of the tooth (e.g. first and second teeth 52$A^1$, 52$A^2$) are determined such that the tooth can sustain a force due to an impact on the helmet. As best shown in FIG. 19, the tooth may have a generally rectilinear or straight portion 150 followed by a shorter arcuate or curved portion 152. The straight portion 150 may have a length between 0.8 cm and 1.2 cm and the curved portion 152 may extend over a length between 0.1 cm to 0.4 cm. The thickness of the tooth may be between 0.1 cm and 0.3 cm. The tooth may have a width between 0.8 cm and 1.2 cm.

The left and right portions of the first shell 12 may have left and right sliding surfaces, each of the left and right sliding surfaces having first and second projections 72 (pegs) extending inwardly, wherein the left and right portions of the second shell 14 have left and right sliding surfaces, each of the left and right sliding surfaces having first and second slots 70 extending along an axis substantially parallel to the longitudinal axis A-A, and wherein the left and right sliding surfaces of the first shell 12 overlap at least partially the left and right sliding surface of the second shell 14.

The first and second projections 72 register in the first and second slots 70 respectively such that the first and second projections 72 are moveable within the first and second slots 70 between first and second sliding positions when the first and second shells 12, 14 move from the first and second locked positions. The left and right sliding surfaces of the first shell 12 may at least partially overlap the left and right sliding surface of the second shell 14.

The left and right sliding surfaces of the first and second shells 12, 14 may define smooth, interference-free sliding surfaces that are adapted to be in contact with each other when the helmet 10 is secured in a selected position. The interference-free sliding surfaces of the helmet 10 still experience minor unavoidable friction, but can be moved in relation to each other without substantial interference and in a smooth movement.

The slot and peg assembly allows the first shell 12 and the second shell 14 to slide backwards and forwards and guides their relative movement. The slots 70 determine the path of movement of the first shell 12 and the second shell 14 with respect to each other. As can be seen in FIGS. 13A, 14, 15 and 16A, the slots 70 may be oriented in a slightly downward sloping direction from the rear to the front of the helmet 10. Alternatively, the slots 70 may be positioned at any angle depending on how the first shell 12 and the second shell 14 are designed to move in relation to each other.

The above description of the embodiments should not be interpreted in a limiting manner since other variations, modifications and refinements are possible within the scope of the present invention. The scope of the invention is defined in the appended claims and their equivalents.

The invention claimed is:

1. An adjustable sports helmet, said helmet comprising:

a) a first shell portion;

b) a second shell portion, said first and said second shell portions being moveable one with relation to the other to adjust a fit of the helmet on a wearer's head;

c) an adjustment mechanism, including:

i) an actuator including at least one tooth, the actuator being mounted to the second shell portion;

ii) an aperture on the second shell portion configured to receive the tooth;

iii) an elongated band associated with the first shell portion and extending to the second shell portion such that relative movement between the first and the second shell portions produces a corresponding movement between the band and the aperture on the second shell portion, the band including a plurality of apertures arranged longitudinally on the band and configured for receiving individually the tooth;

iv) the actuator being moveable between a locked position and a released position, in the locked position the tooth extending in the aperture on the second shell portion and in one of the apertures on the band, in the released position the tooth clearing the one aperture of the band to allow the band to be repositioned relative the aperture on the second shell portion;

v) wherein the second shell portion has an outer side and an opposite inner side, the adjustable helmet including a backing member on the inner side of the second shell portion, the band being located between the second shell portion and the backing member;

vi) wherein the band slidingly moves relative to the backing member when the first shell portion and the second shell portion are moved one with relation to the other;

vii) wherein the actuator constitutes a single control operable by the wearer to adjust a relative position of the first shell portion with relation to the second shell portion;

viii) wherein the backing member registers with the aperture on the second shell portion and when the actuator is in the locked position, the tooth engages the backing member, and when the actuator is in the released position, the tooth disengages from the backing member.

2. The adjustable sports helmet as defined in claim 1, wherein the backing member has an aperture, the tooth penetrating the aperture when the actuator is in the locked position.

3. The adjustable sports helmet as defined in claim 2, wherein when the actuator is in the released position, the tooth clears the aperture on the backing member.

4. AnThe adjustable sports helmet as defined in claim 3, wherein the backing member remains stationary with relation to the second shell portion when the first and second shell portions move one with relation to the other.

5. AnThe adjustable sports helmet as defined in claim 1, wherein the actuator includes a plurality of teeth.

6. The adjustable sports helmet as defined in claim 5, wherein the plurality of teeth are configured to engage simultaneously a plurality of apertures on the band when the actuator is in the locked position.

7. The adjustable sports helmet as defined in claim 6, wherein the second shell portion includes a plurality of apertures for receiving respective teeth of the actuator when the actuator is in the locked position.

8. The adjustable sports helmet as defined in claim 7, wherein the backing member includes a plurality of apertures for receiving the plurality of teeth.

9. The adjustable sports helmet as defined in claim 7, wherein the teeth are curved.

10. The adjustable sports helmet as defined in claim 8, wherein the second shell portion includes a recess for receiving the actuator, when the actuator is in the locked position.

11. AnThe adjustable sports helmet as defined in claim 7, wherein the helmet has a longitudinal axis extending centrally along the helmet, the longitudinal axis intersecting the actuator.

12. The adjustable sports helmet as defined in claim 11, wherein the actuator pivotally moves between the locked position and the released position about an axis that is generally transverse to the longitudinal axis.

13. AnThe adjustable sports helmet as defined in claim 12, wherein the helmet has a pair of spaced apart ridge portions on an exterior surface of the helmet, the ridge portions extending longitudinally on the top portion of the helmet and on a back portion thereof, the actuator residing between the ridge portions.

14. The adjustable sports helmet as defined in claim 13, wherein the first shell portion is configured to cover at least partially a front region and side regions of a wearer's head when the helmet is worn and the second shell portion is configured to cover at least partially a rear region of the wearer's head when the helmet is worn.

15. The adjustable sports helmet as defined in claim 1, wherein the actuator includes a cam member.

16. The adjustable sports helmet as defined in 15, wherein the cam member is operable in response to a pivotal movement of the actuator.

17. The adjustable sports helmet as defined in claim 1, wherein the helmet is a hockey helmet or a lacrosse helmet.

18. An adjustable sports helmet, said helmet comprising:

a) a first shell portion;

b) a second shell portion, said first and said second shell portions being moveable one with relation to the other to adjust a fit of the helmet on a wearer's head;

c) an adjustment mechanism, including:

i) an actuator including at least one tooth, the actuator being mounted to the second shell portion;

ii) an aperture on the second shell portion configured to receive the tooth;

iii) an elongated band associated with the first shell portion and extending to the second shell portion such that relative movement between the first and the second shell portions produces a corresponding movement between the band and the aperture on the second shell portion, the band including a plurality of apertures arranged longitudinally on the band and configured for receiving individually the tooth;

iv) the actuator being moveable between a locked position and a released position, in the locked position the tooth extending in the aperture on the second shell portion and in one of the apertures on the band, in the released position the tooth clearing the one aperture of the band to allow the band to be repositioned relative the aperture on the second shell portion;

v) wherein the second shell portion has an outer side and an opposite inner side, the adjustable helmet including a backing member on the inner side of the second shell portion, the band being located between the second shell portion and the backing member;

vi) wherein the band slidingly moves relative to the backing member when the first shell portion and the second shell portion are moved one with relation to the other;

vii) wherein the actuator constitutes a single control operable by the wearer to adjust a relative position of the first shell portion with relation to the second shell portion;

viii) wherein the actuator includes a plurality of teeth configured to engage simultaneously a plurality of apertures on the band when the actuator is in the locked position;

ix) wherein the second shell portion includes a plurality of apertures for receiving respective teeth of the actuator when the actuator is in the locked position.

19. The adjustable sports helmet as defined in claim 18, wherein the backing member includes a plurality of apertures for receiving the plurality of teeth.

20. The adjustable sports helmet as defined in claim 18, wherein the teeth are curved.

21. The adjustable sports helmet as defined in claim 18, wherein the second shell portion includes a recess for receiving the actuator, when the actuator is in the locked position.

22. The adjustable sports helmet as defined in claim 18, wherein the helmet has a longitudinal axis extending centrally along the helmet, the longitudinal axis intersecting the actuator.

23. The adjustable sports helmet as defined in claim 22, wherein the actuator pivotally moves between the locked position and the released position about an axis that is generally transverse to the longitudinal axis.

24. The adjustable sports helmet as defined in claim 23, wherein the helmet has a pair of spaced apart ridge portions on an exterior surface of the helmet, the ridge portions extending longitudinally on the top portion of the helmet and on a back portion thereof, the actuator residing between the ridge portions.

25. The adjustable sports helmet as defined in claim 24, wherein the first shell portion is configured to cover at least partially a front region and side regions of a wearer's head when the helmet is worn and the second shell portion is configured to cover at least partially a rear region of the wearer's head when the helmet is worn.

26. An adjustable sports helmet, said helmet comprising:

a) a first shell portion;

b) a second shell portion, said first and said second shell portions being moveable one with relation to the other to adjust a fit of the helmet on a wearer's head;

c) an adjustment mechanism, including:

i) an actuator including a cam member and at least one tooth, the actuator being mounted to the second shell portion;

ii) an aperture on the second shell portion configured to receive the tooth;

iii) an elongated band associated with the first shell portion and extending to the second shell portion such that relative movement between the first and the second shell portions produces a corresponding movement between the band and the aperture on the second shell portion, the band including a plurality of apertures arranged longitudinally on the band and configured for receiving individually the tooth;

iv) the actuator being moveable between a locked position and a released position, in the locked position the tooth extending in the aperture on the second shell portion and in one of the apertures on the band, in the released position the tooth clearing the one aperture of the band to allow the band to be repositioned relative the aperture on the second shell portion;

v) wherein the second shell portion has an outer side and an opposite inner side, the adjustable helmet including a backing member on the inner side of the second shell portion, the band being located between the second shell portion and the backing member;

vi) wherein the band slidingly moves relative to the backing member when the first shell portion and the second shell portion are moved one with relation to the other;

vii) wherein the actuator constitutes a single control operable by the wearer to adjust a relative position of the first shell portion with relation to the second shell portion.

27. The adjustable sports helmet as defined in 26, wherein the cam member is operable in response to a pivotal movement of the actuator.

28. The adjustable sports helmet as defined in claim 27, wherein the helmet has a longitudinal axis extending centrally along the helmet, the longitudinal axis intersecting the actuator.

29. The adjustable sports helmet as defined in claim 28, wherein the actuator pivotally moves between the locked position and the released position about an axis that is generally transverse to the longitudinal axis.

* * * * *